US006125757A

United States Patent [19]

Lemelin

[11] Patent Number: 6,125,757

[45] Date of Patent: Oct. 3, 2000

[54] METHOD AND APPARATUS FOR PERFORMING A FLYING PRINTING PLATE CHANGE

[75] Inventor: Michael Robert Lemelin, Dover, N.H.

[73] Assignee: Heidelberger Druckmaschinen AG, Heidelberg, Germany

[21] Appl. No.: 09/174,595

[22] Filed: Oct. 19, 1998

[51] Int. Cl.[7] ..... B41F 27/06

[52] U.S. Cl. ..... 101/477; 101/415.1; 101/486; 101/DIG. 36

[58] Field of Search ..... 101/477, 415.1, 101/216, 183, 485, 486, 378, DIG. 36

[56] References Cited

U.S. PATENT DOCUMENTS

| | | | |
|---|---|---|---|
| 5,537,926 | 7/1996 | Beisel et al. | 101/477 |
| 5,549,045 | 8/1996 | D'Heureuse et al. | 101/477 |
| 5,562,033 | 10/1996 | Schild et al. | 101/216 |
| 5,619,929 | 4/1997 | Engelmann et al. | 101/477 |
| 5,701,822 | 12/1997 | Metrope | 101/477 |
| 5,709,151 | 1/1998 | Durr et al. | 101/477 |
| 5,738,015 | 4/1998 | Kusch et al. | 101/477 |

FOREIGN PATENT DOCUMENTS

| | | |
|---|---|---|
| 195 48 819 | 7/1997 | Germany . |
| 196 03 666 | 6/1998 | Germany . |
| 2 309 668 | 8/1997 | United Kingdom . |

*Primary Examiner*—Christopher A. Bennett
*Attorney, Agent, or Firm*—Burns, Doane, Swecker & Mathis, LLP

[57] ABSTRACT

The present invention is directed to a web fed rotary printing press which can perform a printing plate change on the fly, while preventing the printing plate from touching an associated moving blanket cylinder. In accordance with exemplary embodiments, a nip roller is used to securely press the printing plate toward the plate cylinder during printing plate replacement, such that only a small gap exists between the stopped plate cylinder and the moving blanket cylinder. As such, the entire printing unit need not be modified to account for ink train cylinder movement.

17 Claims, 5 Drawing Sheets

METHOD AND APPARATUS FOR PERFORMING A FLYING PRINTING PLATE CHANGE

BACKGROUND OF THE INVENTION

1. Field of the Invention

The present invention relates to an apparatus and method for printing, and more particularly, to an apparatus and method for replacing printing plates on a plate cylinder contained within a printing unit, while the printing unit is continuously printing on a web of material.

2. State of the Art

In commercially available web fed rotary printing presses, a plurality of printing units can be arranged one above the other to print on one or more paper webs which pass through the printing units in a substantially vertical direction. Printing units typically include multiple rolls that apply ink to one or both sides of the paper webs. An ink train includes multiple rolls in contiguous contact, to transport ink to printing plates of each printing unit. The ink train meters ink supplied to the printing plates, so that the ink is provided as a uniform film of a desired thickness.

A substantial amount of time is required to exchange printing plates. The printing plates are replaced if, for example, a new paper is being printed with a different advertisement in each of different communities. Due to the relatively fixed arrangement of the printing units and a limited amount of space available in a press room, the printing units are not easily accessible by the press operators, such that printing plates can not be easily replaced.

Moreover, even when access to the printing plates is achieved, replacement can be complex. When a printing plate is changed within a printing unit of a printing press, the printing process is stopped within that unit by removing any contact of blanket cylinders with the moving paper web. For example, German Patent DE 195 48 819 describes a stacked printing press arrangement in which a blanket cylinder can be separated from the running web to change a printing plate on an associated plate cylinder. A pivotable guard is provided for protecting the press operator from the rotating cylinders and rollers of another printing unit currently in operation. However, one drawback of this type of printing plate change is that an entire printing unit must be taken out of operation during the printing plate change. Because the entire printing unit must be shut down, an auxiliary printing unit having redundant printing plates is required.

It is known to change printing plates of web fed rotary printing presses "on-the-fly." To perform such a printing plate change, a plate cylinder on one side of the printing press is moved away from the moving web to perform the printing plate change, while the second side of the web is still being printed. For example, German Patent DE 196 03 666 discloses a printing plate change where a plate cylinder is displaced from the blanket cylinder and its rotation is stopped. A guard is inserted into the space created by the displaced plate cylinder to ensure that nothing (e.g. a printing plate or press operator) gets caught in the moving parts of the press. However, the insertion of a safety shield between the cylinders takes up too much space and requires physical movement of the printing carriage (i.e., all cylinders) of the printing unit. Movement of the printing carriage during a printing plate change requires the entire printing unit of a conventional press to be redesigned, and reduces the cost effectiveness of performing a printing plate change on the fly.

British Patent GB 2309668 describes a web offset rotary printing unit in which blanket cylinders remain in contact with the web during a printing plate exchange. A plate cylinder can be moved away from a transfer cylinder to change the printing plates. While the system of GB 2309668 requires only half of a printing unit to be shut down, and requires only half of a redundant printing unit to be used, a large amount of space is allotted between the rotating blanket cylinder and the plate cylinder whose printing plate is being changed. This, in turn, can require movement of the entire ink train and therefore modification of the printing unit. Additionally, there is no mechanism, other than the insertion of a guard, to ensure that a printing plate being removed or placed onto the plate cylinder will not get caught in the moving blanket cylinder.

Accordingly, it would be desirable to provide a method and apparatus for performing a printing plate change on the fly within a conventional printing unit which does not require movement of the entire printing carriage. Additionally, it would be desirable to reduce the space between the blanket cylinder and the plate cylinder whose printing plate is being changed, while continuing to ensure that nothing gets caught in the moving parts of the printing unit.

SUMMARY OF THE INVENTION

The present invention is directed to a web fed rotary printing press which can perform a printing plate change on the fly, while preventing the printing plate from touching an associated moving blanket cylinder. In accordance with exemplary embodiments, a nip roller is used to securely press the printing plate toward the plate cylinder during printing plate replacement, such that only a small gap is needed to safely displace the stopped plate cylinder from the moving blanket cylinder. As such, the entire printing unit need not be modified to account for increased ink train and plate cylinder movement.

In an exemplary embodiment of the present invention, a web fed rotary printing press for printing on a web is disclosed which comprises: a first printing unit section for printing on one side of the web; and a second printing unit section for printing on another side of the web, the second printing unit further comprising a blanket cylinder; a plate cylinder; and a nip cylinder for applying pressure to the plate cylinder during replacement of a printing plate on said plate cylinder.

In another exemplary embodiment of the present invention, a method for replacing a printing plate in a web fed rotary printing press is disclosed wherein the rotary printing press comprises at least two printing unit sections, each printing unit section comprising a blanket cylinder, a plate cylinder and a nip roller for applying pressure to the plate cylinder during replacement of a printing plate. The method of replacing the printing plate comprises steps of removing the plate cylinder in one of said at least two printing unit sections from contact with the blanket cylinder in said one printing unit section, and applying pressure to the plate cylinder in said one printing unit section using said nip roller when replacing the printing plate.

BRIEF DESCRIPTION OF THE DRAWINGS

Other objects and advantages of the present invention will become apparent to those skilled in the art from the following detailed description of the invention, when read in conjunction with the accompanying drawings wherein like elements have been designated with like reference numerals and wherein.

DETAILED DESCRIPTION OF THE PREFERRED EMBODIMENTS

Figure 1:
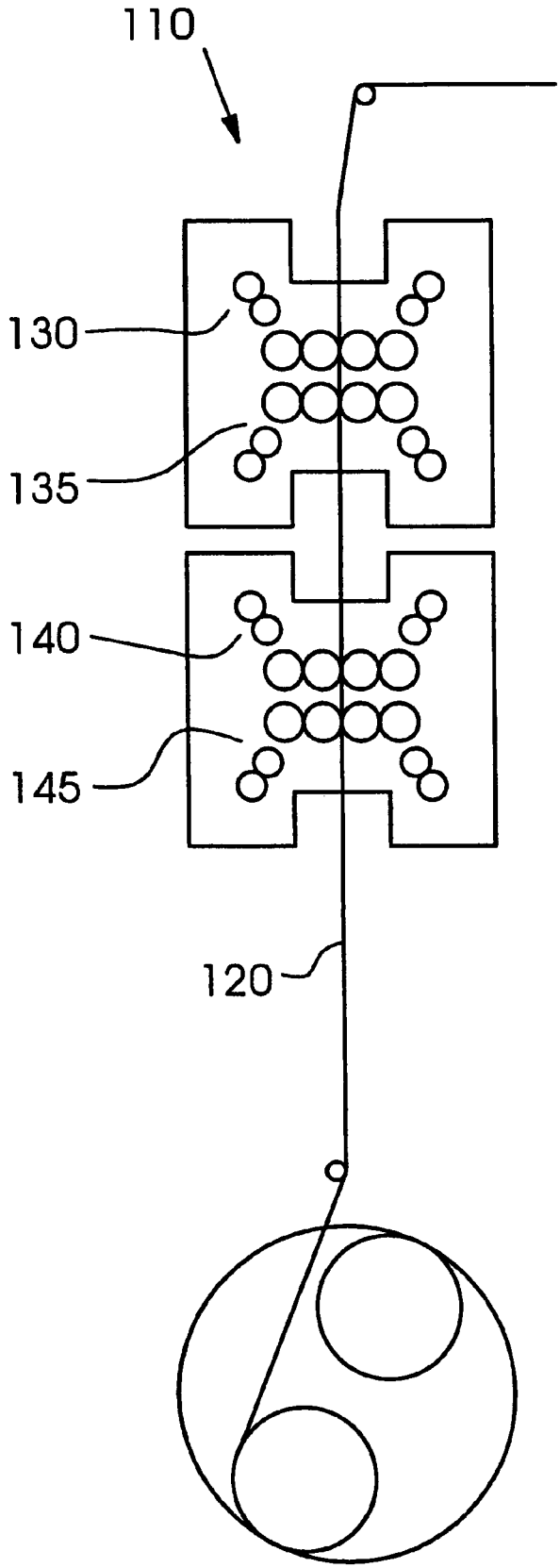
FIG. 1 illustrates an overview of an exemplary web fed rotary printing press having a tower arrangement according to the present invention.

FIG. 1 shows a partial cross-sectional view of an exemplary web fed rotary printing press in accordance with the invention. The press includes at least one tower arrangement 110 for printing a single color or a multicolor image on a web 120. The web 120 can be, for example, between 1200 and 1600 millimeters wide, or any other width. The web 120 travels in a substantially linear direction through the tower 110. For example, the web can travel along a substantially vertical path, as shown in FIG. 1. Alternatively, as those skilled in the art will appreciate, the web path can be in a substantially horizontal direction, or in a substantially linear path at any desired angle relative to the vertical direction shown.

The tower 110 as shown includes four printing units 130, 135, 140 and 145, each for printing an image in one of a plurality of different colors on the web 120. Each printing unit includes two sections, one section being provided for printing on each side of the web. Depending upon the type of printing performed, additional or fewer printing units can be included within the tower 110. Also, a redundant printing unit can be employed in the tower 110 to perform a printing operation when, for example, a printing unit is not operational due to mechanical problems or a printing plate change is being performed.

Figure 2:
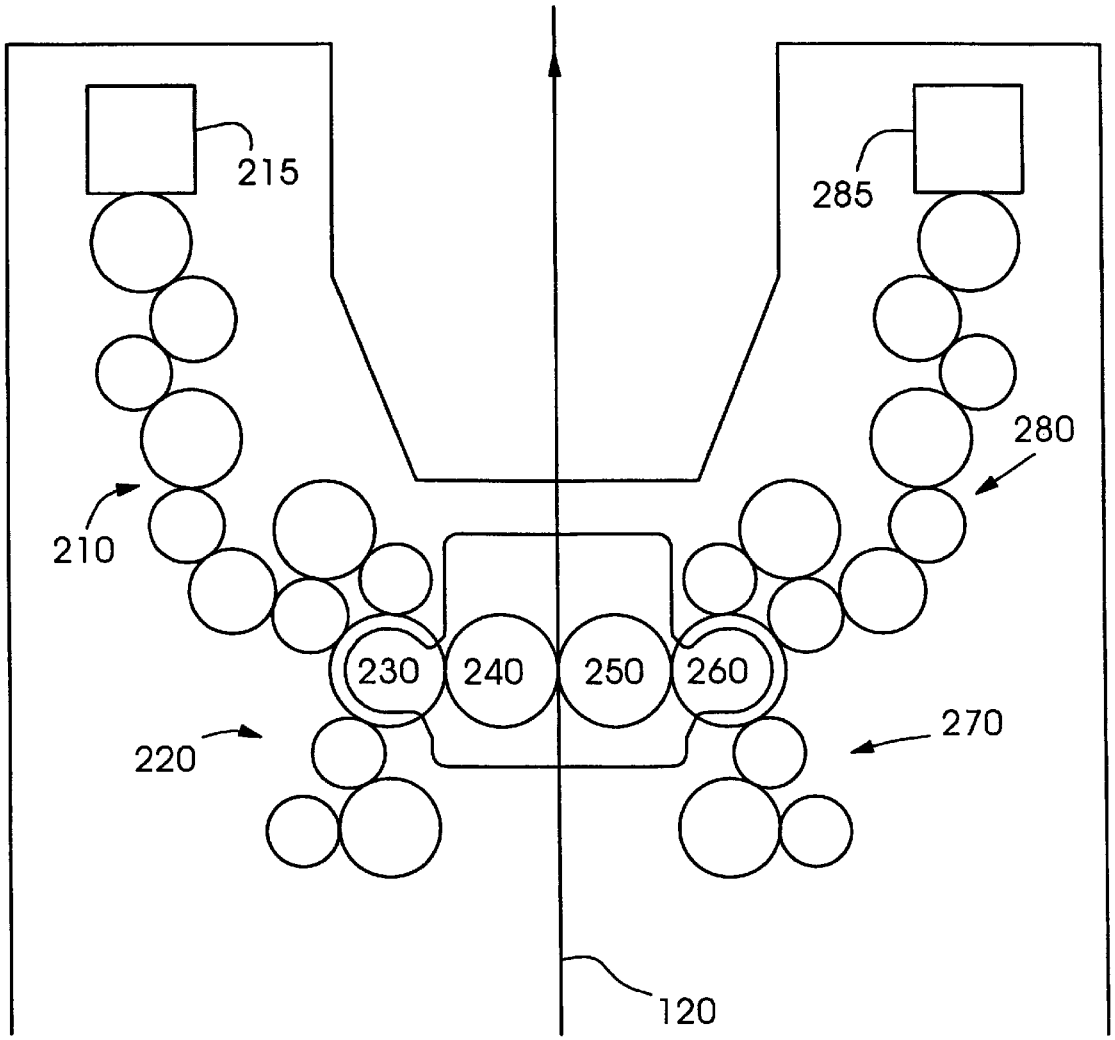
FIG. 2 illustrates an exemplary printing unit in accordance with an embodiment of the present invention.

FIG. 2 illustrates a side view of printing unit 130 in accordance with an embodiment of the invention. Web 120 passes between and receives an image on either side from each of blanket cylinders 240 and 250. The associated plate cylinders 230 and 260 have, on the periphery of each cylinder, printing plates which contain the images to be printed. Each plate cylinder 230 and 250 is supplied with water by the dampening cylinders 220 and 270 respectively, while ink trains 210 and 280 supply ink to the printing plates attached to plate cylinders 230 and 260, respectively. As is well known in the art, the water displaces the ink at specific locations on the plate cylinders 230 and 260, so that ink on the remaining locations of the plate cylinders represents the image to be printed. Ink modules 215 and 285 supply ink to the ink trains 210 and 280.

During normal printing, ink is applied to both sides of the web 120 and all of the cylinders are rotating against at least one other cylinder to transfer ink, apply water and dampen vibrations. When a printing plate change is performed, the associated plate cylinder is removed from contact with the blanket cylinder and stopped.

Figure 3:
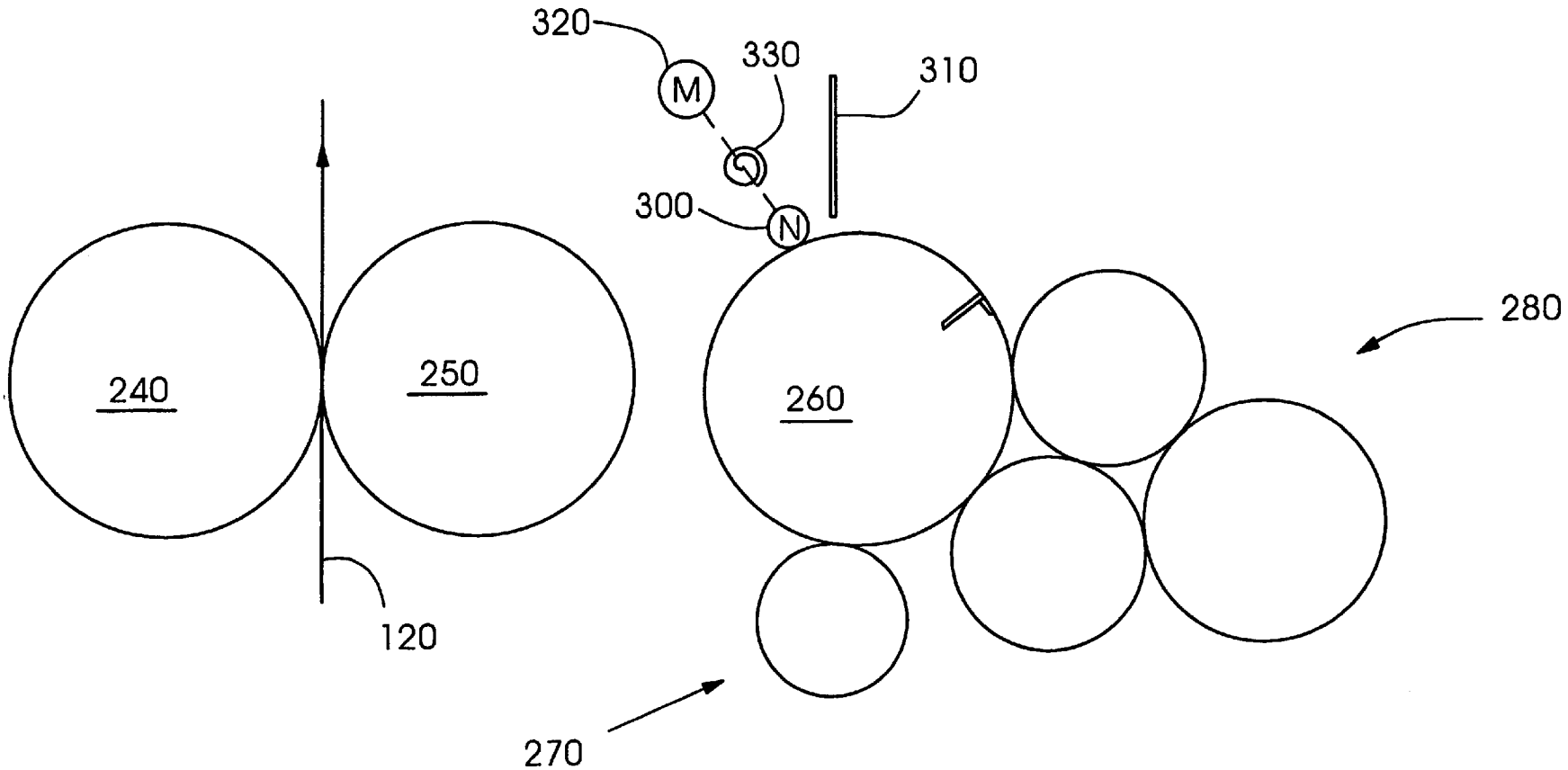
FIG. 3 illustrates a printing cylinder separated from a moving blanket cylinder to perform a flying plate change in accordance with an embodiment of the present invention.

FIG. 3 illustrates the positioning of the plate and blanket cylinders when performing a flying printing plate change in accordance with an exemplary embodiment of the present invention. When a plate change is to be performed in any one of the FIG. 1 printing units 130, 135, 140 and 145, the plate cylinder on one side of the web is displaced from contact with the associated blanket cylinder. In the FIG. 3 illustration, the right side of the printing unit 130 is illustrated as having a printing plate change such that plate cylinder 260 is displaced from contact with blanket cylinder 250. However, the left side of the printing unit can be identically configured, and can have the printing plate changed in the same manner, except that the direction of rotation of the plate cylinder could, for example, be reversed as compared to the right side to effect a plate change.

Due to use of a nip roller 300, a gap on the order of approximately 2.5 millimeters, or more or less is involved to change a printing plate. Because only minimal movement of the plate cylinder 260 is needed to establish this gap, the ink train 280 and damping cylinders 270 of a print carriage need not be significantly moved. At this distance from the blanket cylinder 250, the plate cylinder 260 can be brought to a stop to perform the printing plate change, and will not interfere with the remainder of the printing unit 130 which can continue to print on an opposite side of the moving web 120. The printing which was performed by the section of the printing unit whose plate is being changed can be performed by a single redundant section included in the printing press.

Once the plate cylinder 260 has stopped, the nip roller 300 is brought into contact with the plate cylinder, or with a printing plate located on the plate cylinder. The nip roller 300 applies pressure to the printing plate and/or plate cylinder, which provides a drag force that resists rotation. The nip roller 300 prevents the printing plate from moving toward, and getting caught up in, the moving blanket cylinder 250 during replacement (i.e., both removal and installation) of printing plates on the plate cylinder 260. When removing a printing plate from the plate cylinder 260, the nip roller 300 holds the plate down against the plate cylinder and provides a load against which the printing plate can be pulled out. A plate guard 310 can be inserted in a vicinity (e.g., at the top) of the plate cylinder 260 to ensure that no objects inadvertently get caught in the moving blanket cylinders of the printing unit during flying plate changes.

Figure 4:
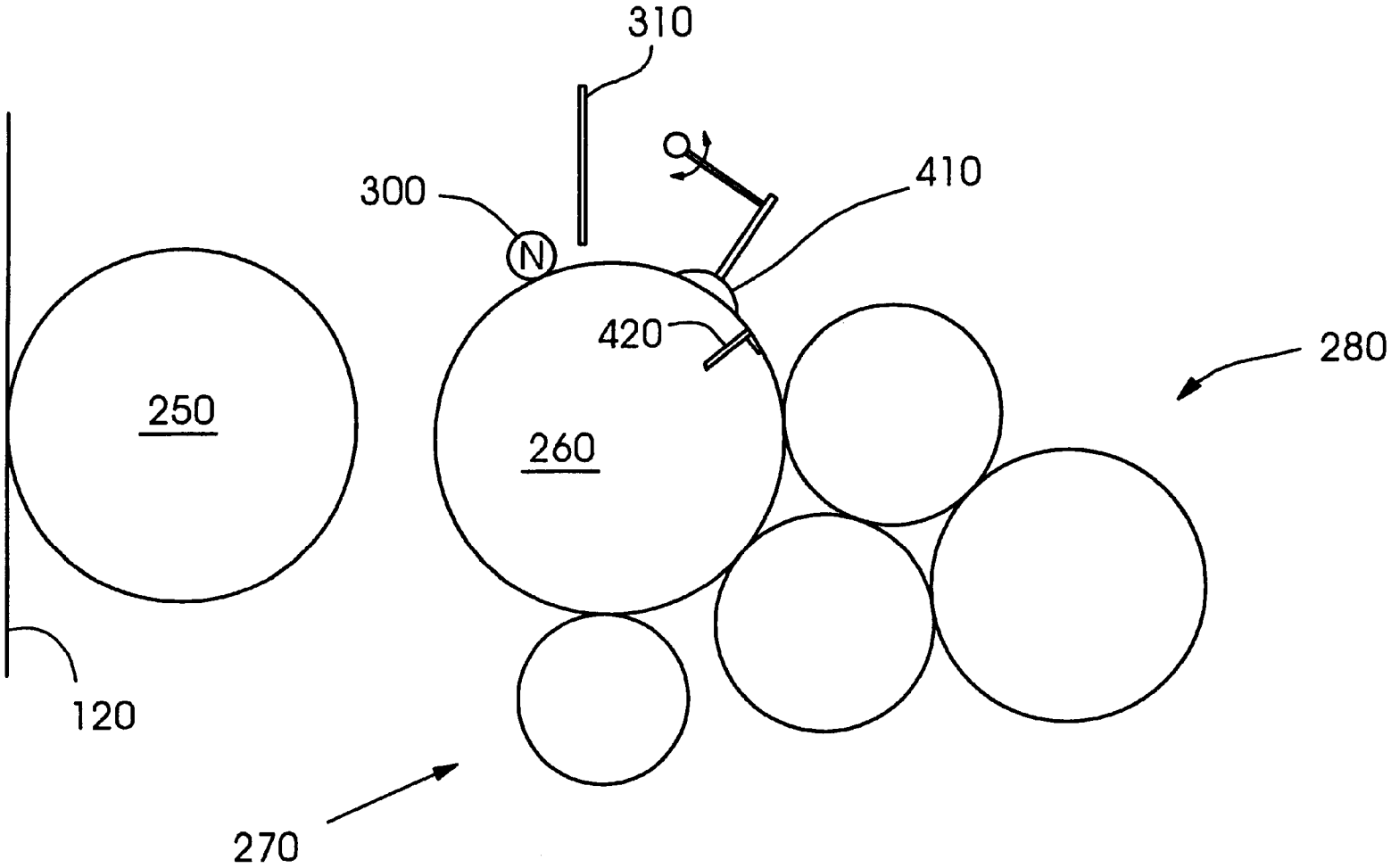
FIGS. 4 and 5 illustrate the use of a suction cup and nip roller to assist in replacement of a printing plate in accordance with an exemplary embodiment of the present invention.

As illustrated in FIG. 4, when removing a printing plate from the plate cylinder 260, a pneumatically operated suction cup 410 can be employed, either manually by a press operator or automatically through the use of an actuator, to attach to the printing plate located on the plate cylinder 260. The suction cup 410 can be attached near the plate's trail edge, which is tucked into a gap 420 located on the plate cylinder 260, and is then lifted from the surface of the plate cylinder.

Figure 5:
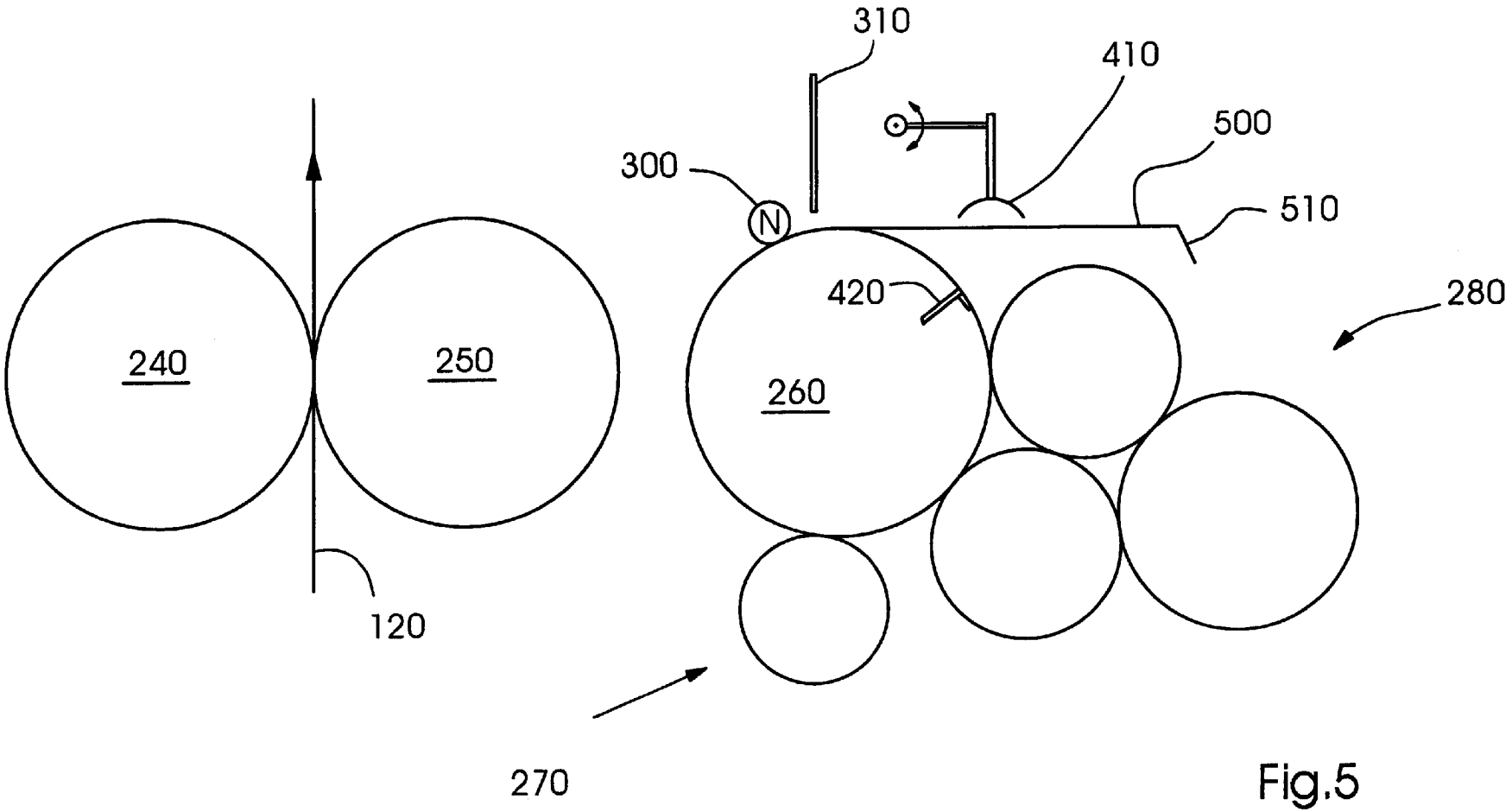

As illustrated in FIG. 5, when the suction cup 410 is lifted from the surface of the plate cylinder 260, the printing plate 500 is lifted also. Note that the printing plate's trail edge 510 is bent to fit into the gap 420 located in the plate cylinder 260. With the nip roller 300 exerting pressure on the printing plate 500, a press operator can remove the suction cup 410 from the printing plate 500, and slowly rotate the plate cylinder in a clockwise direction to remove the printing plate 500. During removal of the printing plate, the nip roller 300 can exert constant pressure onto a remaining portion of the printing plate still located on the plate cylinder 260, thereby preventing the remaining portion from swinging out and interfering with the moving blanket cylinder 250. When the plate cylinder 260 has rotated sufficiently, the lead edge of the printing plate 500, which is also tucked into the gap 420, can be removed.

When a new printing plate 500 is to be installed on plate cylinder 260, the lead edge of the printing plate 500 is inserted into the gap 420 across the width of the plate cylinder. Once the lead edge of the printing plate 500 is inserted into the gap 410, the plate cylinder 260 is rotated in a counterclockwise fashion to draw the remainder of the printing plate 500 onto the plate cylinder 260. During this time, the nip roller 300 exerts constant pressure on the plate cylinder 260 to tuck the printing plate 500 onto the cylinder. When the plate cylinder has rotated sufficiently, the printing plate's trail edge 510 is tucked into the gap 420. The plate cylinder 260 can again be rotated one revolution to ensure that the printing plate 500 is properly tucked onto the plate cylinder 260.

Nip roller 300 prevents the new printing plate 500 from arching out and contacting the moving blanket cylinder 250 as it is being installed onto the plate cylinder 260. Additionally, the use of the nip roller 300 for the installation of the printing plate 500 allows for an automatic tucking of the printing plate 500 onto the plate cylinder 260. Manual tucking of the printing plate 500 is not as uniform or effective as when done through the use of the nip roller 300. Additionally, the use of the nip roller allows for a guard to be placed further forward in the printing unit, thereby increasing safety and reducing the amount of printing cylinder displacement required for moving the plate cylinder.

In accordance with an embodiment of the present invention, an optional motor 320 shown in FIG. 3 can be used to act as a brake which adjusts drag of the nip roller 300. Alternately, or in addition, the nip roller 300 can employ a torsion spring 330 to adjust the drag of the nip roller 300 as it is pressed toward the plate cylinder 260. Where the nip roller 300 employs a torsion spring, the nip roller 300 can be placed into contact with the plate cylinder 260 and the tension can be varied according to the direction and the amount of rotation of the plate cylinder 260. When a new printing plate 500 is added to the plate cylinder 260, the tension would increase in the spring. As the printing plate 500 is taken off the plate cylinder 260, tension is released in the spring. In either direction, the nip roller 300 would apply desired force onto the plate cylinder 260.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A web fed rotary printing press for printing on a web, comprising:

a first printing unit section for printing on one side of said web; and a second printing unit section for printing on another side of said web, said second printing unit section further including a blanket cylinder, a plate cylinder, and a nip roller positioned relative to said plate cylinder and said blanket cylinder to hold a printing plate against said plate cylinder over a portion of said plate cylinder which faces said blanket cylinder by applying pressure to said plate cylinder during replacement of a printing plate on said plate cylinder.

2. The web fed rotary printing press of claim 1, further comprising:

a motor for adjusting drag and said nip roller.

3. The web fed rotary printing press of claim 1, further comprising:

a torsion spring for adjusting drag of said nip roller.

4. The web fed rotary printing press of claim 2, further comprising:

a torsion spring for adjusting drag of said nip roller.

5. The web fed rotary printing press of claim 1, further comprising:

a guard placed in a vicinity of said blanket cylinder.

6. The web fed rotary printing press of claim 1, further comprising:

a pneumatically operated suction cup for removing a printing plate from said plate cylinder.

7. The web fed rotary printing press of claim 1, wherein said first printing unit section further comprises:

a blanket cylinder, and a plate cylinder.

8. The web fed rotary printing press of claim 7, wherein said first printing unit section contacts said web to continue printing on said one side of the web during displacement of said plate cylinder in said second printing unit from said blanket cylinder of said second printing unit section.

9. The web fed rotary printing press of claim 7, wherein said first printing unit section further comprises:

a nip roller for applying pressure to said plate cylinder during replacement of a printing plate in said first printing unit section.

10. The web fed rotary printing press of claim 1, wherein said plate cylinder of said second printing unit section is displaced from said blanket cylinder during replacement of a printing plate on said plate cylinder.

11. The web fed rotary printing press of claim 10, further comprising:

an ink train for supplying ink to said blanket cylinder of said second printing unit section via said plate cylinder, said ink train remaining stationary during displacement of said plate cylinder from contact with said blanket cylinder of said second printing unit section during replacement of said printing plate.

12. A method for replacing a printing plate in a web fed rotary printing press, wherein said rotary printing press comprises at least two printing unit sections, each printing unit section comprising, a blanket cylinder, a plate cylinder and a nip roller, said method comprising the steps of:

removing said plate cylinder in one of said at least two printing unit sections from contact with said blanket cylinder in said one printing unit section; and applying pressure to said plate cylinder in said one printing unit section using said nip roller positioned relative to said plate cylinder and said blanket cylinder to hold a printing plate against said plate cylinder over a portion of said plate cylinder which faces said blanket cylinder when replacing the printing plate.

13. The method for replacing a printing plate of claim 12, further comprising a step of:

continuing to print on at least one side of said web while removing said plate cylinder in said one of said at least two printing unit sections from contact with said blanket cylinder.

14. The method for replacing a printing plate of claim 12, further comprising the step of:

adjusting drag of said nip roller.

15. The method for replacing a printing plate of claim 12, further comprising a step of:

supplying ink to said blanket cylinder of said one printing unit section via said plate cylinder, said ink train remaining stationary during displacement of said plate cylinder from contact with said blanket cylinder of said one printing unit section during replacement of said printing plate.

16. The web fed rotary printing press of claim 1, wherein the distance between said plate cylinder and said blanket cylinder is approximately 2.5 mm, during replacement of said printing plate.

17. The method for replacing a printing plate of claim 12, wherein the distance between said plate cylinder and said blanket cylinder is approximately 2.5 mm, during replacement of said printing plate.

* * * * *